US008040206B2

(12) United States Patent
Stafford

(10) Patent No.: US 8,040,206 B2
(45) Date of Patent: Oct. 18, 2011

(54) CIRCULAR AND/OR LINEAR POLARITY FORMAT DATA RECEIVING APPARATUS

(75) Inventor: Gary Stafford, Stevenage (GB)

(73) Assignee: Invacom Ltd., Stevenage, Hertsfordshire (GB)

( * ) Notice: Subject to any disclaimer, the term of this patent is extended or adjusted under 35 U.S.C. 154(b) by 535 days.

(21) Appl. No.: 11/912,080

(22) PCT Filed: Apr. 4, 2006

(86) PCT No.: PCT/GB2006/001234

§ 371 (c)(1),
(2), (4) Date: Feb. 27, 2008

(87) PCT Pub. No.: WO2006/111702

PCT Pub. Date: Oct. 26, 2006

(65) Prior Publication Data

US 2008/0157902 A1 Jul. 3, 2008

(30) Foreign Application Priority Data

Apr. 21, 2005 (GB) ..... 0508034.6

(51) Int. Cl.
*H01P 5/12* (2006.01)
*H01P 3/00* (2006.01)
*H01P 1/00* (2006.01)

(52) U.S. Cl. ..... 333/137; 333/21 A; 333/21 R; 333/108; 333/113; 333/122; 333/239; 333/248

(58) Field of Classification Search ..... 333/21 A, 333/21 R, 137, 108, 113, 122, 239, 248
See application file for complete search history.

(56) References Cited

U.S. PATENT DOCUMENTS

| | | | | |
|---|---|---|---|---|
| 2,682,610 | A | 6/1954 | King | |
| 3,059,186 | A | 10/1962 | Allen | |
| 3,327,250 | A | 6/1967 | Sleeper, Jr. | |
| 4,167,715 | A | 9/1979 | Ohm et al. | |
| 5,010,348 | A | 4/1991 | Rene et al. | |
| 5,568,158 | A * | 10/1996 | Gould | 343/756 |
| 6,388,537 | B1 | 5/2002 | Matsumoto | |
| 2008/0186110 | A1 | 8/2008 | Stafford | |

FOREIGN PATENT DOCUMENTS

| | | | |
|---|---|---|---|
| JP | 60014501 | A1 | 5/1985 |
| WO | 2006027588 | A1 | 3/2006 |

* cited by examiner

*Primary Examiner* — Robert Pascal
*Assistant Examiner* — Kimberly Glenn
(74) *Attorney, Agent, or Firm* — LeClairRyan, a Professional Corporation

(57) ABSTRACT

An apparatus has an antenna configured to receive transmitted digital data, wherein the data comprises circular polarity (CP) and linear polarity (LP) format signals. The apparatus also has a waveguide coupled to the antenna and configured to propagate: 1) a first component of the CP format signal which is received; 2) a second component of the CP format signal which is received, said second component being substantially orthogonal to said first component; and 3) the LP format signal which is received. The apparatus further has one or more phase adjusters configured to allow adjustment to be made to match a phase of the first and second components of the CP format signal. The apparatus also has one or more amplitude adjusters configured to allow adjustments to be made to match an amplitude of the first and second components of the CP format signal.

39 Claims, 6 Drawing Sheets

CIRCULAR AND/OR LINEAR POLARITY FORMAT DATA RECEIVING APPARATUS

This application is a national stage application under 35 U.S.C. §371 of PCT/GB2006/001234, filed Apr. 4, 2006, which claims benefit of Great Britain Application No. 0508034.6, filed Apr. 21, 2005.

The invention to which this application relates, is apparatus for the reception of data which is broadcast, typically via a satellite transmission system, to the apparatus. The apparatus is typically provided at residential or industrial premises and typically includes, an antenna, a receiving horn and a Low Noise Block (LNB) assembly. The apparatus can then be connected to one or more Broadcast Data Receivers (BDR) within the premises which allow the processing of the received data, typically into video and audio for a range of selectable television channels to be shown when the user selects a channel from the range of available channels.

Conventionally, the data is transmitted to the locations in one of two formats, a linear polarity (LP) format or a circular polarity (CP) format and within certain predesignated frequency ranges such as 10.7 to 12.75 GHz for linear polarity and 12.2 to 12.7 GHz for circular polarity. A problem which is increasingly being found is that the number of channels, and hence data, which is required to be transmitted cannot be accommodated within the available frequency ranges. This is particularly prevalent with the smaller CP frequency range.

A solution to this is to allow the apparatus to receive data in either or both of the circular or polarity formats but there are specific problems experienced in achieving this. The applicant has filed co-pending applications which address some of these problems and which allow the splitting of the data into data paths and processing, in the appropriate way, components of CP and LP data so that all of the same is available for selection and use in response to a user selection, such that, for example, if a channel is selected which is generated from data transmitted with a CP format this is equally as available, as LP format data required for another user selectable channel.

Another problem which is experienced is ensuring that adjustment can take place to take into account transmission and processing errors and to ensure that both, or one or other of, the phase and amplitude components of the split CP data paths is/are balanced to allow the processing of the data to occur efficiently and successfully. Typically, in order to allow the adjustment of the phase to achieve phase balance, adjustment is required at a waveguide provided as part of the LNB, while the adjustment of the amplitude, to allow amplitude balance to be achieved, requires adjustment at processing circuitry downstream of the waveguide.

The aim of the present invention is to provide apparatus which allows the adjustment of the phase and/or amplitude of the received CP format data signals components to be achieved in a reliable and efficient manner and thereby allow the provision of receiving apparatus with both LP and CP data available for selection and use.

In a first aspect of the invention there is provided apparatus for receiving transmitted digital data, said apparatus configured for the reception of data in a circular polarity (CP) and/or a linear polarity (LP) format and including means for receiving data in both formats and including a waveguide wherein said apparatus includes adjustment means which allow adjustment to be made with respect to the amplitude and/or phase of at least one format of the received data.

By adjusting the wavelengths via the adjustment means, so the phase and/or balance of the orthogonal components of the received CP format data signals can be balanced and matched when emitted for use with the.

In one embodiment the adjustment means for one orthogonal component of the CP data wavelength is mounted in the waveguide so as to be perpendicular to the adjustment means for the other orthogonal component of the CP data.

In one embodiment first and second adjustment means are provided. Typically each adjustment means is a member provided to protrude to a selected extent into the waveguide from a wall of the waveguide, and the extent to which the member protrudes into the waveguide channel can be adjusted.

In one embodiment the adjustment means are located so as to be perpendicular to the plane of polarisation of the orthogonal component which is to be adjusted. In one embodiment the adjustment means causes the localised change in the height of the waveguide and hence the alteration of the wavelength of said data signal.

In one embodiment the adjustment means are mounted in the waveguide in conjunction with deflection means, a first adjustment means mounted upstream of the first deflection means for adjustment for the first orthogonal component and the second adjustment means mounted upstream of the second deflection means for adjustment for the second orthogonal component.

In one embodiment the waveguide which is used is as defined in the applicant's co-pending Application GB0419884.2, incorporated herein by reference, where there is provided a first channel along which CP and LP data passes when received, said first channel connected to a second channel along which data of a first polarity is deflected and, downstream thereof, a third channel along which data of a second polarity is deflected, said first and second polarity data signals leaving the second and third channels via respective apertures provided in the same plane.

Typically the adjustment means for both polarity format data signal are provided at spaced locations in the first channel.

Alternatively one, or both, of the adjustment means are provided in respective second or third channels.

In addition, or separately to the phase adjustment means, the apparatus in accordance with a further aspect of the invention includes an assembly for adjustment of the amplitude of the orthogonal components of the CP format data once it leaves the waveguide, said apparatus including a means for splitting the orthogonal components into separate paths, said adjustment assembly including a means for ensuring that the data in the paths, pass to a transformer or hybrid in an amplitude balanced condition, and wherein said adjustment assembly includes a means for adjustment of the bias or drain current of at least one amplifier positioned on one of the paths.

In one embodiment each of the data paths which lead to the hybrid from the waveguide include a plurality of amplifiers. Preferably each of the said data paths includes three amplifiers in series.

In one embodiment the condition of the second and/or third amplifiers in order from the split of the data paths from the waveguide are adjustable in at least one data path to allow the drain current to be altered to allow the amplitude balance to be achieved. Typically the first amplifier in each path is held constant.

Typically the adjustment of the drain current is achieved using a variable resistor potential divider.

The result of this method is to allow the orthogonal component (i.e Horizontal (H) and Vertical (V)) output from the last amplifier in each path to be matched in terms of amplitude prior to entering the hybrid. In one embodiment there is no attempt made to match the input to the first amplifier in each data path in terms of amplitude.

In one embodiment the hybrid used is a 3 dB multistage hybrid and more typically a 2 stage hybrid.

In accordance with this embodiment all, or the majority, of the gain on the data paths occurs before the hybrid as the amplifiers are positioned in the circuit before the hybrid.

In accordance with a further aspect of the invention there is provided apparatus for receiving transmitted digital data, said apparatus including a waveguide configured to receive data in at least a circular polarity (CP) format and means for processing both selectively wherein said apparatus includes adjustment means which allow adjustment to be made to match the phase of the orthogonal components (H) and (V) of the received CP format data signals.

Typically the apparatus receives data in the linear polarity format also

In one embodiment the adjustment means are provided in the waveguide.

Typically the adjustment means allow adjustment to one of the orthogonal components to match it in phase with the other. The adjustment means can be in the form of a member which protrudes to a selected extent into a passage of the waveguide.

In a further aspect of the invention there is provided apparatus for receiving transmitted digital data, in circular polarity (CP) and/or linear polarity (LP) format and means for processing both selectively wherein said apparatus includes adjustment means which allow adjustment to be made to match the amplitude of the H and V orthogonal components of the received CP format data signals.

In one embodiment the adjustment means is a variable resistor potential divider. Typically the orthogonal components are split to pass along respective circuit paths, each including a plurality of amplifiers and the adjustment means acts on at least one of the amplifiers in at least one of the paths.

In one embodiment each path includes three amplifiers in series and the second and/or third amplifies are adjustable in at least one of the paths to allow adjustment and matching of the amplitude.

Typically the adjustment which is made is with respect to the drain current value in at least one of the data paths.

Typically adjustment means to allow adjustment to match the phase of the orthogonal components are provided.

In a further aspect of the invention there is provided apparatus for receiving transmitted digital data, said apparatus including a waveguide configured for the reception of data in a circular polarity (CP) and/or a linear polarity (LP) format and wherein said waveguide includes adjustment means which allow adjustment to be made with respect to the components of the received data signals, said adjustment means allowing independent adjustment of the phase of the said components of the received data.

Typically the apparatus further includes adjustment means to allow matching of the amplitude of the said components.

In whichever embodiment there the apparatus is connected to at least one broadcast data receiver and a switch configuration via which a user selection to watch a particular television channel can be detected and the appropriate data for said channel supplied to the receiver.

In a further aspect of the invention there is provided a method for the reception of broadcast data in both linear and circular polarity formats, said method including the steps of passing the received linear and circular polarity format data to a switch configuration for selective usage in response to a user selection to view and/or listen to a particular television channel via the apparatus and wherein adjustment can be selectively performed prior to said switch configuration to allow either or both of the phase and/or amplitude matching of the orthogonal components of the received circular polarity format data.

In one embodiment the adjustment of the phase is performed in the waveguide along which data signals pass and the amplitude matching adjustment occurs downstream of the same.

Typically the said apparatus and adjustment occurs within the LNB assembly located externally of a premises, said LNB connected to at least one broadcast data receiver via which television and/or radio channels can be selected for viewing or listening. The apparatus as herein described ensures that both Circular and linear polarity data can be received in an equally selectable and available manner and thus ensures that data over a wider frequency range can be transmitted thereby increasing the available bandwidth for said data between both polarity formats.

Specific embodiments of the invention are now described with reference to the accompanying drawings, wherein: —

FIGS. 1*a-e* illustrate an elevation of a waveguide in accordance with one embodiment of the invention;

Figure 1A:
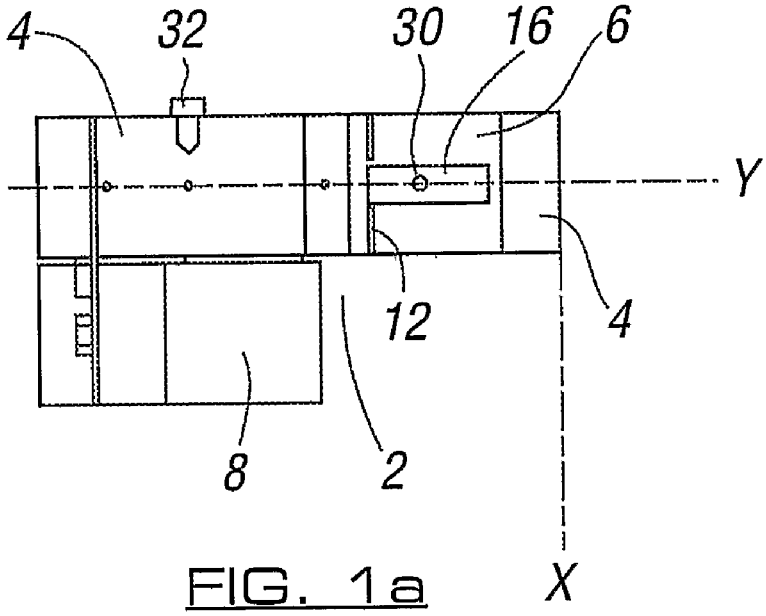
Figure 1B:
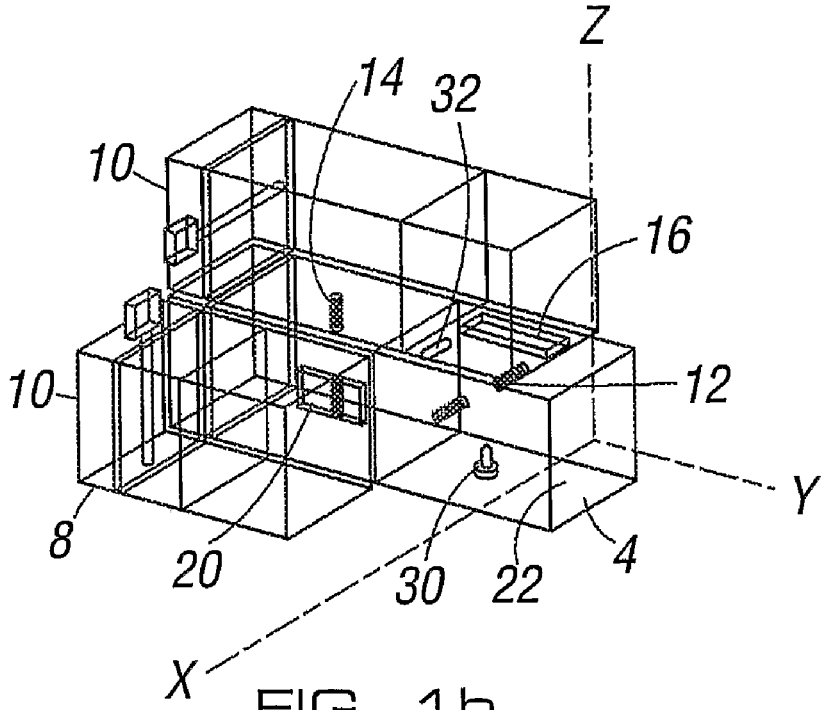
Figure 1C:
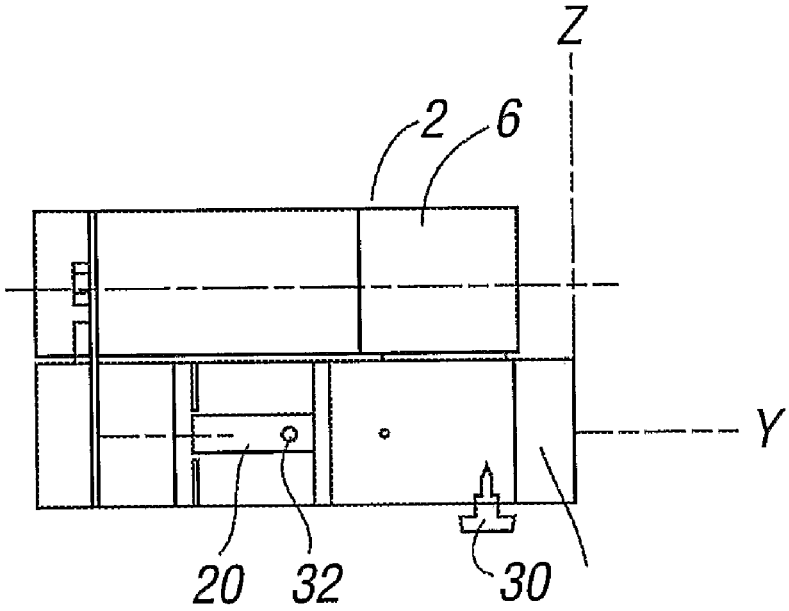
Figure 1D:
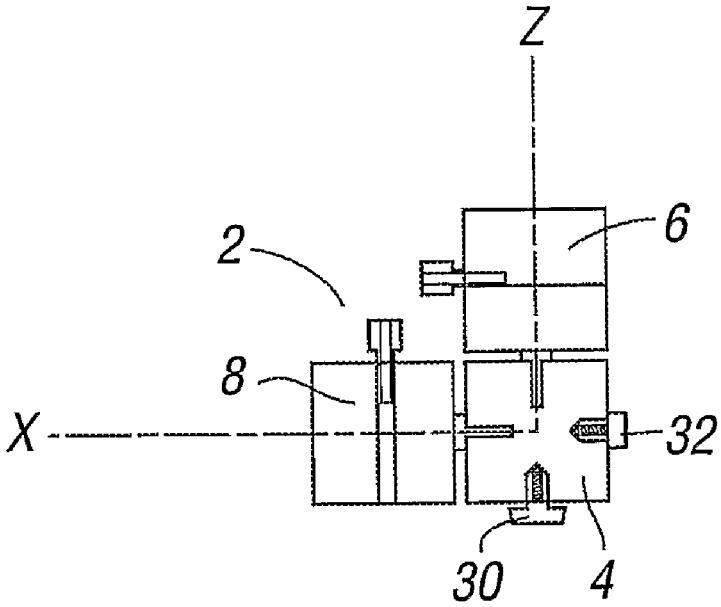
Figure 1E:
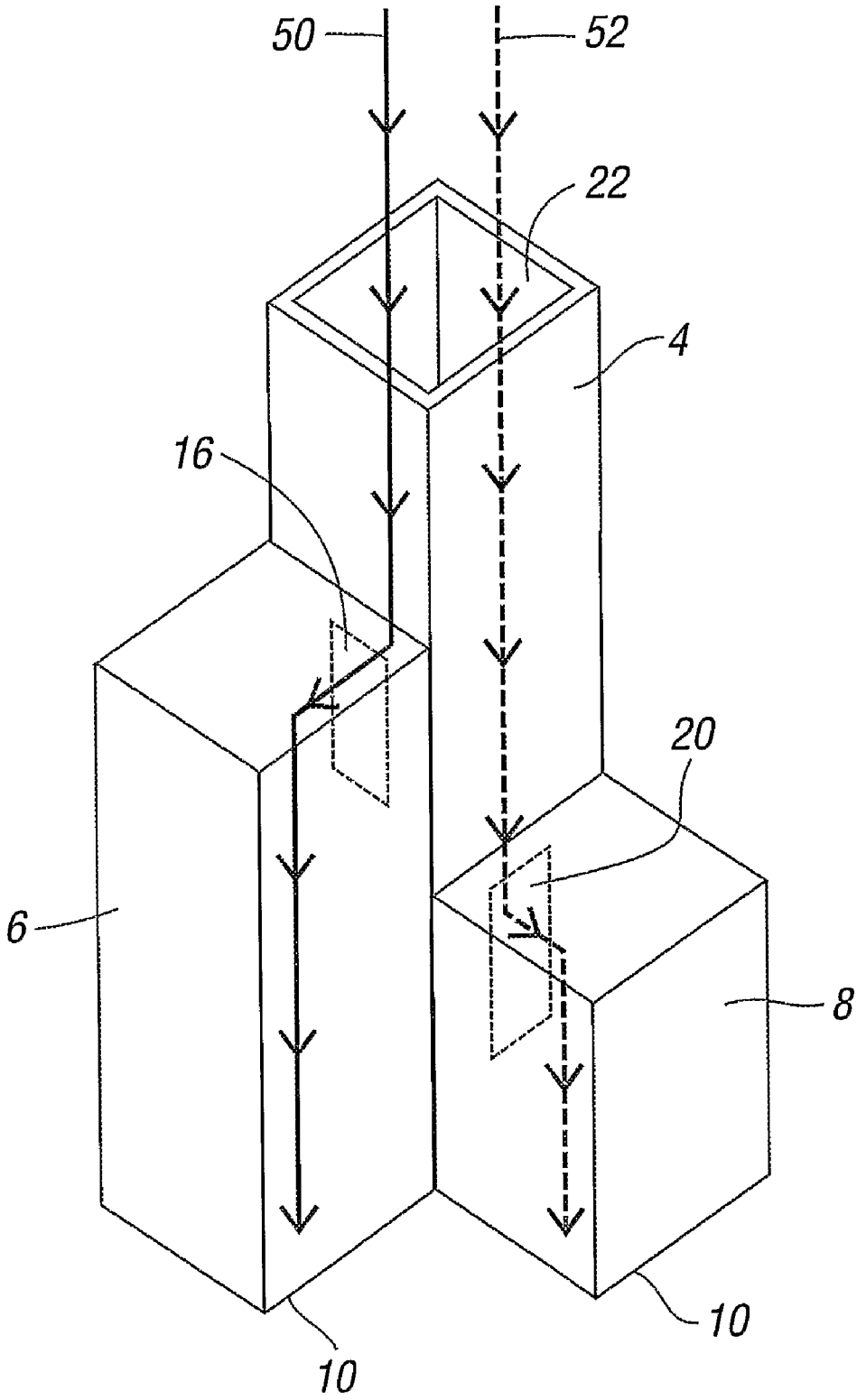

Referring firstly to FIGS. 1*a-e*, there is illustrated a waveguide assembly in accordance with one embodiment of part of the apparatus.

The waveguide assembly 2 includes a body having a series of channels, a first channel 4, a second channel 6 and a third channel 8. The channels 6 and 8 are connected to the first channel 4 so as to allow the selective deflection of orthogonal components of the CP format data signals from the first channel 4 into the channel 6 or 8 respectively with the LP format data typically passing along the first channel.

Each of the channels 6 and 8 have an aperture 10 which lie in the same plane and which allow the data signals to be emitted therefrom.

The first channel 4, includes two sets of deflection means 12, 14. The first set of deflection means 12 are positioned to lie perpendicular to the second set of deflection means 14. Furthermore, the first set of deflection means 12 are positioned adjacent to and typically slightly downstream of, a port 16 and a second set of deflection means 14 are positioned adjacent to and slightly downstream of port 20. The first port 16 leads into the second channel 6 and the second port 20 leads into the third channel 8.

In one embodiment the first and second sets of deflection means are positioned so as to allow the deflection of components of the received signals, in one embodiment of the circular polarity data signals.

Thus, in use, the received linear polarity and circular polarity format signals 50, 52, enter the first channel 4, through the aperture 22 and pass therealong. A first component, typically an orthogonal component of the circular polarity format data of the received signals, are deflected by the first set of deflection means 12 through the aperture 16 and into the second channel 6. The remainder continues along the first channel and a second component, typically the other orthogonal component of the circular polarity format data meets the second set of deflection means 14 at which stage they are deflected through the aperture 20 and into the third channel 8 whereupon the circular and linear polarity data signals 10 are emitted from their respective apertures of the waveguide.

In this implementation, the phase of the orthogonal components of the CP format data can be adjusted by the selective insertion of the two pins or screws (30, 32) or similar tuning elements, each screw affecting one of the orthogonal components. Depending on the actual phase response of the RF amplifiers, which will vary from unit to unit in production, generally only one of the screws (30, 32) will be adjusted since the phase will need to be pushed in one direction or the other but not both. It would also be possible to add a phase length to one of the orthogonal channels and not the other such that a single tuning screw could be used. In this case the zero phase position would leave the screw in a nominal inserted position and then a retraction or further insertion would adjust the phase in either required direction.

It is also possible to adjust the phase by other means, for instance the insertion of a tuning screw in close proximity to a microstrip line or the addition of a slab of bare PCB material or dielectric material over the top of a microstrip line. This will change the effective dielectric constant and increase the effective length and hence phase. The slab of material could be shaped e.g. in a triangular shape and then progressively moved across the microstrip line to gradually change phase; or usage of a trombone microstrip line, allowing a length of metal to be moved up and down a trombone line thus adjusting phase.

Figure 2:
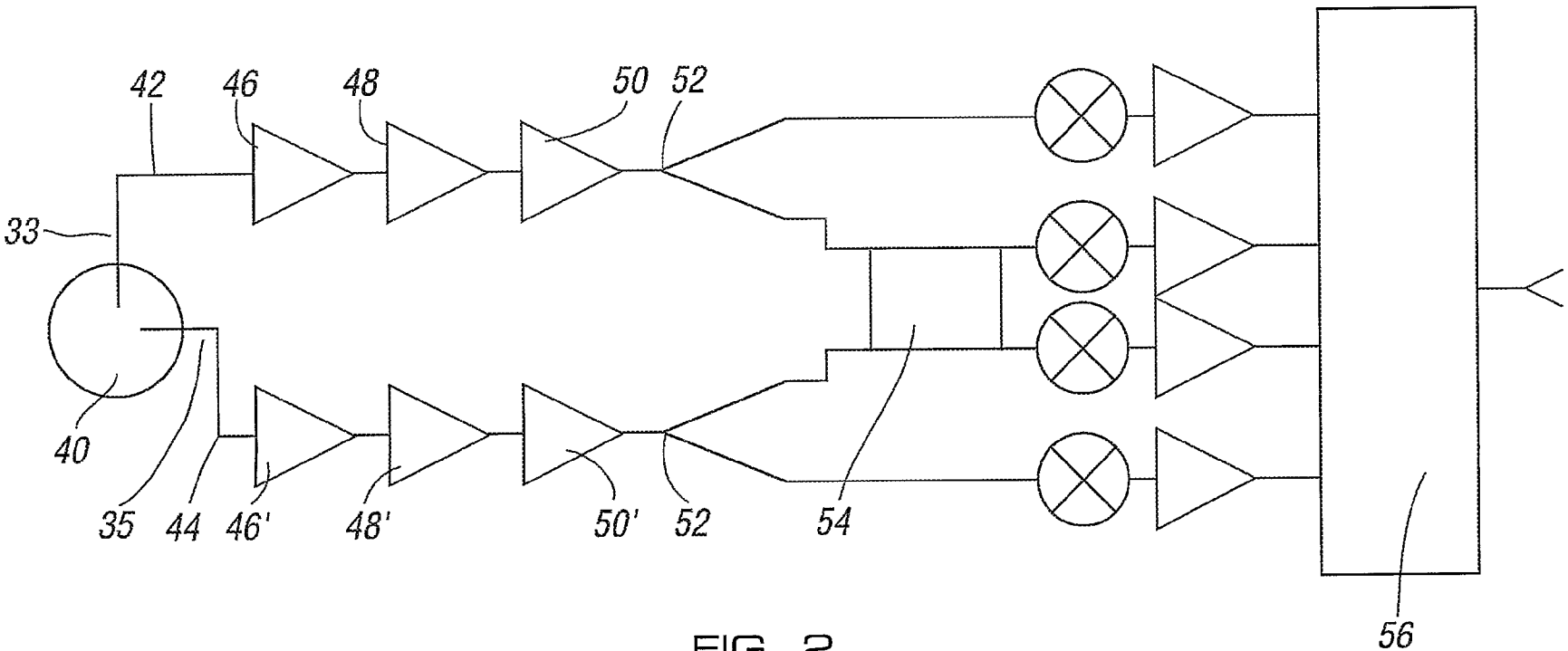
FIG. 2 illustrates an embodiment of a further aspect of the invention.
Figure 3:
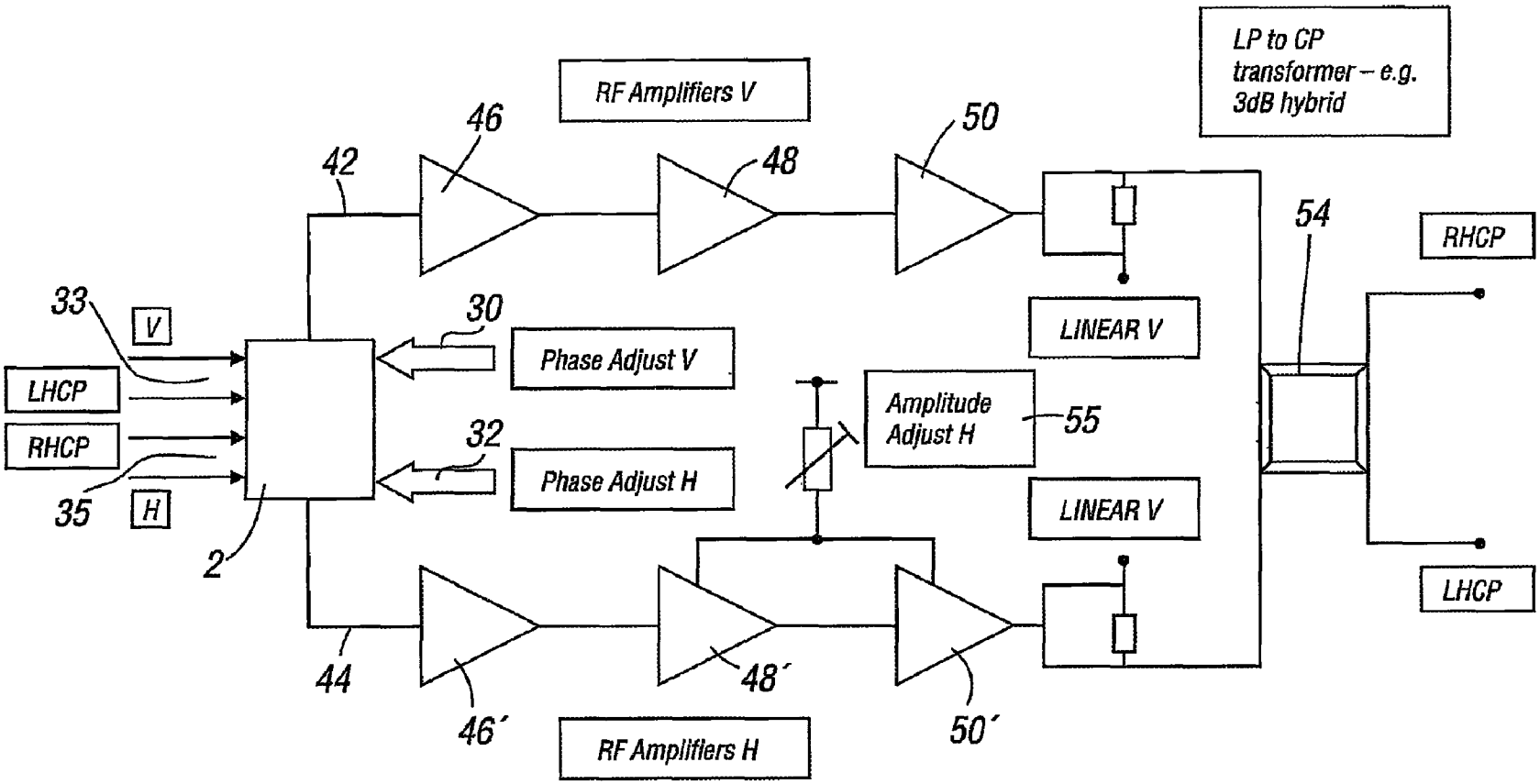
FIG. 3 illustrates a more detailed diagram of the front end of the circuit of FIG. 2.

FIGS. 2 and 3 illustrate a further aspect of the invention wherein there is provided processing circuitry for the signals when emitted from the waveguide. The circuitry is illustrated schematically in FIG. 2 and the front end in more detail in FIG. 3 and is used for the amplitude matching of the orthogonal components of the circular polarity data.

FIG. 3 shows a detailed block diagram of the front-end circuitry of FIG. 2 and the waveguide 2 and including the phase and amplitude adjustment means, without which the circular cross-polar isolation would generally be poor.

An LNB for Circular Polarity format data contains a polarising element in the waveguide to convert the incoming circular polarisation into linear so that it can be picked up on probes inserted into or present in the waveguide. The assembly of the invention has no such polarising element, and it receives CP orthogonal H and V signals or components. It does however maintain a near perfect phase and amplitude relationship between these two orthogonal components. The CP signals, both LHCP and RHCP are picked up therefore by both probes, e.g. for RHCP half the power is present on one orthogonal probe 33 and the other half on the other orthogonal probe 35 but with a 90° phase difference between the two. This phase difference is sign reversed for LHCP.

Both orthogonal components (i.e H and V) are each amplified along respective data paths 42, 44 (46, 48, 50; 46', 48', 50') and presented to the CP-LP transformer or hybrid 54 which is generally a 3 dB hybrid. The amplitude and phase relationship of the two orthogonal components when incident on the hybrid is required not to have been significantly distorted. For this to be the case the phase and amplitude response of the RF amplifiers must be compensated for or tuned such that the amplifiers have a very similar amplitude and phase response.

The amplitude response can be adjusted by varying the bias current to any of the RF Amplifiers, which are typically FET or HEMT devices; this can be achieved by usage of a variable resistor or potential divider 55. One particularly useful implementation of this is shown in FIG. 3 where the 2nd and 3rd stages of one orthogonal channel 44 only are adjusted. This has the advantage that by varying the bias current above and below that of the other stages, the gain of that orthogonal channel 44 can be either reduced or increased relative to the other 42. Provided there is sufficient range of bias current, this then allows the orthogonal component channels amplitude responses to be balanced. In addition, this arrangement has the advantage that the noise figure of both orthogonal channels is almost unaffected by the bias changes, given that for both channels the 1st (and NF dominant) stage bias current remains unchanged.

The amplitude balancing of the data emitted from the data paths 42, 44 is achieved prior to the data entering the Wilkinson Power Dividers 52 and entering the Hybrid 54. Thereafter the data can be processed in a suitable manner for the Circular Polarity (CP) and Linear Polarity (LP) formats as required to ensure that all required and selectable television channels are available to be generated as a result of a user selection received and using a suitable switching configuration such as that shown 56 for specific receiver connections.

Figure 4:
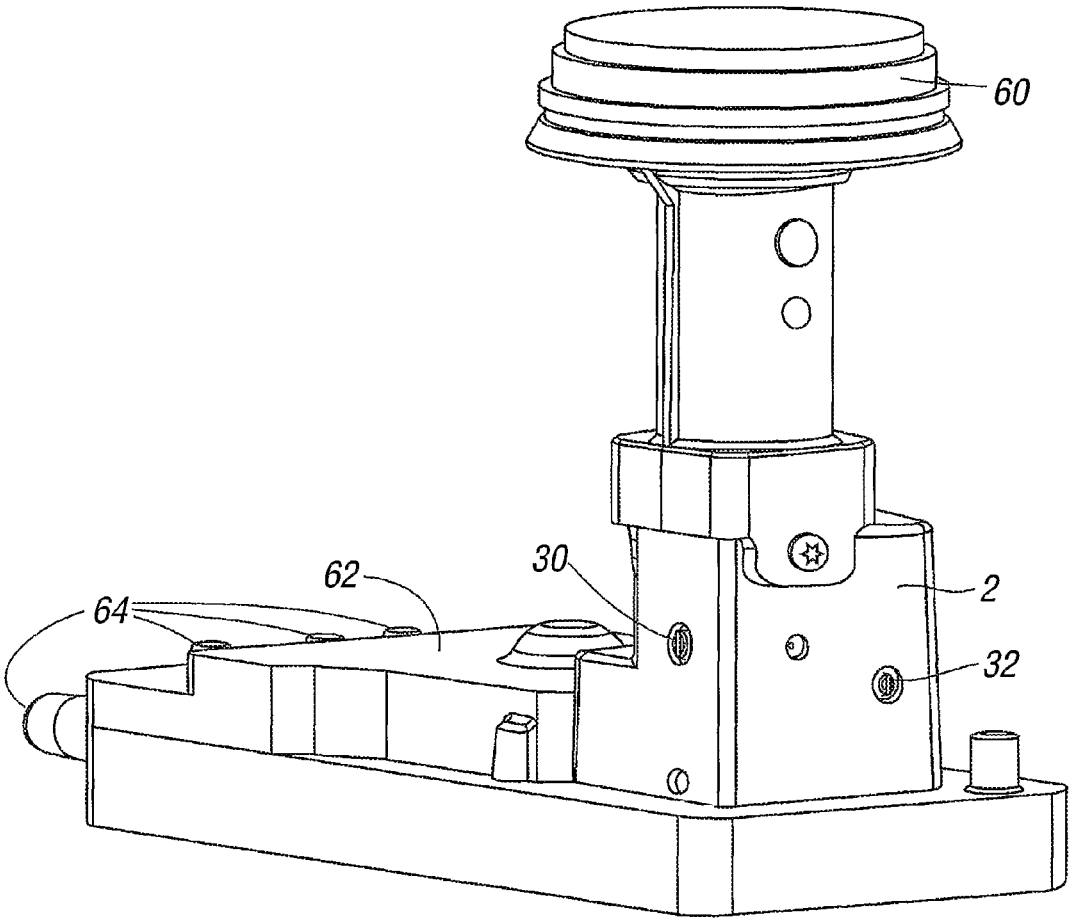
FIG. 4 illustrates a practical implementation of the arrangement of FIGS. 1-3.

FIG. 4 illustrates an arrangement of apparatus formed in accordance with the invention for fitting to a receiving antenna or "dish". The apparatus includes horn 60 leading to a waveguide 2 with adjustment means 30, 32 shown. The waveguide leads to the processing circuitry (not shown) but of the type shown in FIGS. 2 and 3 which is provided within the housing 62 and which in turn leads to the LF output connections 64 to the broadcast data receiver(s) within the process.

Both the phase and amplitude adjustment will typically have no impact on the Linear polarisation format data in that these components are fundamentally isolated by the linear waveguide arrangement and any small phase or amplitude adjustment has no effect on linear cross-polarity and just changes the phase and amplitude response of the LNB by an insignificant amount. However, these small amplitude and phase adjustments have a dramatic impact on the CP cross polar isolation since it balances the signals at the input to the hybrid and effectively nulls the isolation.

The invention claimed is:

1. An apparatus for receiving transmitted digital data, said apparatus being configured for the reception of data in a circular polarity (CP) format and/or a linear polarity (LP) format and comprising means for receiving data in both formats and a waveguide, said apparatus further comprising adjustment means which allow adjustment to be made with respect to amplitude and phase of at least one format of the received data, wherein said adjustment means include first adjustment means provided to allow adjustment to be made to match the phase of first and second orthogonal components of the CP format data which are received and second adjustment means to adjust the amplitude of the CP format data which are received.

2. The apparatus according to claim 1 wherein the first adjustment means allow the phase of said first and second orthogonal components of the CP format data which are received to be balanced and matched before being emitted from the waveguide.

3. The apparatus according to claim 1 wherein the first adjustment means for said first and second orthogonal components of the CP format data is mounted in the waveguide.

4. The apparatus according to claim 1 wherein the first adjustment means includes at least one member provided to protrude to a selected extent into a channel of the waveguide.

5. The apparatus according to claim 4 wherein the extent to which the at least one member protrudes into the waveguide channel can be adjusted.

6. The apparatus according to claim 4 wherein the first adjustment means is located so as to be perpendicular to a plane of polarisation of either the first orthogonal component or the second orthogonal component.

7. The apparatus according to claim 4 wherein the first adjustment means comprises a first phase adjuster that is mounted in the waveguide in conjunction with a first deflection means.

8. The apparatus according to claim 7 wherein:

the first phase adjuster is mounted upstream of the first deflection means and configured to allow adjustment of the phase of the first orthogonal component of the CP format data; and the first adjustment means further comprises a second phase adjuster mounted upstream of a second deflection means and configured to allow adjustment of the phase of the second orthogonal component of the CP format data.

9. The apparatus according to claim 1 wherein the waveguide has a first channel along which the CP and LP format data passes when received, said first channel connected to a second channel along which the first orthogonal component of the CP format data is deflected and, downstream thereof, a third channel along which the second orthogonal component of the CP format data is deflected, said first and second orthogonal components leaving the second and third channels via respective exit apertures.

10. The apparatus according to claim 9 wherein the first adjustment means is provided at spaced locations in the first channel.

11. The apparatus according to claim 9 wherein the first adjustment means is provided in one of the second or third channels.

12. The apparatus according to claim 1 wherein the apparatus includes the second adjustment means after the waveguide.

13. The apparatus according to claim 12, further comprising first and second separate paths after the waveguide, wherein the second adjustment means allows splitting of said first and second orthogonal components into the first and second separate paths, wherein the first and second separate paths lead to a transformer with the first and second orthogonal components in an amplitude balanced condition.

14. The apparatus according to claim 13 wherein the second adjustment means includes means for adjustment of a bias or drain current of at least one amplifier positioned on one of the first and second separate paths.

15. The apparatus according to claim 13 further comprising a plurality of amplifiers on each of the first and second separate paths.

16. The apparatus according to claim 15 wherein for each of said first and second separate paths the plurality of amplifiers comprise a first amplifier, a second amplifier, and a third amplifier in series.

17. The apparatus according to claim 16 wherein a condition of the second amplifier and/or the third amplifier in order from the waveguide in at least one of the first and second separate paths is adjustable via the second adjustment means.

18. The apparatus according to claim 17 wherein the second adjustment means is configured to alter a drain current to allow an amplitude balance or matching to be achieved.

19. The apparatus according to claim 18 wherein the second adjustment means comprises a variable resistor potential divider connected to one of the first and second separate paths on which the drain current alteration is to be made.

20. The apparatus according to claim 17 wherein the first amplifier in each of the first and second separate paths is held constant.

21. The apparatus according to claim 13 wherein each of the first and second separate paths comprises a plurality of amplifiers, and the first and second orthogonal components of the CP format data output from the plurality of amplifiers in each of the first and second separate paths are matched in terms of amplitude prior to entering the transformer.

22. The apparatus according to claim 13 wherein each of the first and second separate paths comprises a plurality of amplifiers, and substantially all of a gain on the first and second separate paths occurs before the transformer as the plurality of amplifiers are positioned in the circuit before the transformer.

23. The apparatus according to claim 1 wherein the second adjustment means is a variable resistor potential divider.

24. The apparatus according to claim 1 wherein said first and second orthogonal components are split into respective circuit paths, each including a plurality of amplifiers and the first adjustment means acts on at least one of the amplifiers in at least one of the circuit paths.

25. The apparatus according to claim 24 wherein each of the circuit paths includes a first amplifier, a second amplifier, and a third amplifier in series and the second and/or third amplifiers are adjustable in at least one of the circuit paths to allow (i) adjustment of the amplitude of at least one of the first and second orthogonal components of the CP format data and (ii) matching of the amplitude of the first and second orthogonal components of the CP format data.

26. The apparatus according to claim 25 wherein the adjustment of the amplitude of at least one of the first and second orthogonal components of the CP format data comprises adjusting a drain current value in at least one of the circuit paths.

27. An apparatus for receiving transmitted digital data, comprising:

a waveguide configured to receive digital data comprising at least a circular polarity (CP) format data signal, wherein the waveguide comprises means for processing the received digital data;

one or more phase adjusters configured to allow adjustment to be made to match a phase of a first component of the CP format data signal and a second component of the CP format data signal, wherein the second component of the CP format data signal is substantially orthogonal to the first component of the CP format data signal; and one or more amplitude adjusters configured to allow an adjustment to be made to match an amplitude of the first and second components of the CP format data signal.

28. The apparatus according to claim 27 wherein the waveguide is further configured to receive data comprising a linear polarity (LP) format data signal and includes means for selectively processing the CP format data signal and the LP format data signal.

29. The apparatus according to claim 27 wherein the one or more phase adjusters are provided in the waveguide.

30. The apparatus according to claim 29 wherein at least one of the phase adjusters comprises a member which protrudes to a selected extent into a passage of the waveguide.

31. The apparatus according to claim 27 wherein the one or more phase adjusters allow adjustment to one of the first and second components of the CP format data signal to match it in phase with the other component of the CP format data signal.

32. The apparatus according to claim 27, wherein:

the first component of the CP format data signal comprises a Left hand (LHCP) component of the CP format data signal; and the second component of the CP format data signal comprises a Right hand (RHCP) component of the CP format data signal.

33. An apparatus for receiving transmitted digital data, comprising:

a waveguide configured for the reception of a circular polarity (CP) format data signal and a linear polarity (LP) format data signal, wherein said waveguide comprises one or more phase adjusters configured to allow independent adjustment to be made to a phase of a first component of the CP format data signal and/or a phase of a second component of the CP format data signal, wherein the second component of the CP format data signal is substantially orthogonal to the first component of the CP format data signal; and one or more amplitude adjusters configured to allow adjustments to be made to match an amplitude of the first and second components of the CP format data signal.

34. The apparatus according to claim 33 wherein the apparatus is connected to at least one broadcast data receiver and a switch configuration via which a user selection to watch a particular television channel can be detected and the digital data appropriate for said channel supplied to the receiver.

35. The apparatus according to claim 33, wherein:

the first component of the CP format data signal comprises a Left hand (LHCP) component of the CP format data signal; and the second component of the CP format data signal comprises a Right hand (RHCP) component of the CP format data signal.

36. A method for the reception of broadcast data in both linear and circular polarity formats, said method including the steps of passing the received linear and circular polarity format data to a switch configuration for selective usage in response to a user selection to view and/or listen to a particular television channel and wherein adjustment can be selectively performed via first and second adjustment means prior to said switch configuration to allow both of phase and amplitude of orthogonal components of the received circular polarity format data to be matched.

37. The method according to claim 36 wherein the adjustment of the phase is performed via the first adjustment means in a waveguide along which the received digital data pass and adjustment to achieve the amplitude matching occurs via second adjustment means located downstream of the waveguide.

38. The apparatus according to claim 36, wherein:

the first component of the CP format data signals comprises a Left hand (LHCP) component of the CP format data signal; and the second component of the CP format data signals comprises a Right hand (RHCP) component of the CP format data signal.

39. An apparatus for receiving transmitted digital data comprising:

an antenna configured to receive the transmitted digital data, wherein the transmitted digital data comprises a circular polarity (CP) format data signal and linear polarity (LP) format data signal, the CP format data signal comprising a first component and a second component that is substantially orthogonal to the first component;

a waveguide coupled to the antenna and configured to propagate the first and second orthogonal components of the CP format data signal which is received and the LP format data signal which is received;

one or more phase adjusters configured to allow adjustment to be made to match a phase of the first and second orthogonal components of the CP format data signal; and one or more amplitude adjusters configured to allow adjustments to be made to match an amplitude of the first and second orthogonal components of the CP format data signal.

* * * * *

UNITED STATES PATENT AND TRADEMARK OFFICE

CERTIFICATE OF CORRECTION

PATENT NO. : 8,040,206 B2
APPLICATION NO. : 11/912080
DATED : October 18, 2011
INVENTOR(S) : Gary Stafford It is certified that error appears in the above-identified patent and that said Letters Patent is hereby corrected as shown below:

In Claim 38, at Col. 10, line 7, delete "36" and insert --39--.

Signed and Sealed this
Tenth Day of January, 2012

David J. Kappos

David J. Kappos
*Director of the United States Patent and Trademark Office*